US005188267A

United States Patent [19]

Sargent et al.

[11] Patent Number: 5,188,267

[45] Date of Patent: Feb. 23, 1993

[54] SUPPORT ARRANGEMENTS FOR FIREFIGHER'S SELF-CONTAINED BREATHING APPARATUS

[75] Inventors: Dennis Sargent, Salt Lake, Utah; Donald Aldridge, New Carlisle, Ohio; Bill McKenney, Winchester, Ky.

[73] Assignee: Lion Apparel, Inc., Dayton, Ohio

[21] Appl. No.: 735,789

[22] Filed: Jul. 25, 1991

[51] Int. Cl.[5] ..... A45F 3/04

[52] U.S. Cl. ..... 224/215; 224/228; 2/81; 2/95; 128/202.19; 128/205.22

[58] Field of Search ..... 224/215, 228, 208, 205, 224/209; 2/93, 94, 95, 96, 81, 97; 128/202.19, 205.22

[56] References Cited

U.S. PATENT DOCUMENTS

| | | | |
|---|---|---|---|
| 1,082,213 | 12/1913 | Robinson | 2/81 |
| 2,804,071 | 8/1957 | Johnston | 128/201.23 |
| 2,982,105 | 5/1961 | Akers | 405/186 |
| 3,074,074 | 1/1963 | Lovering | 2/94 |
| 3,135,098 | 6/1964 | Root | 128/205.22 X |
| 3,973,643 | 8/1976 | Hutchinson | 2/94 X |
| 4,068,314 | 1/1978 | Yellen et al. | 2/94 |
| 4,090,509 | 5/1978 | Smith | 128/202.19 |
| 4,273,216 | 6/1981 | Weissmann | 2/94 X |
| 4,502,155 | 3/1985 | Itoi | 2/94 X |
| 4,518,107 | 5/1985 | Amos | 224/215 |
| 4,640,215 | 2/1987 | Purifoy | 128/205.22 X |
| 4,689,831 | 9/1987 | Greenberger et al. | 2/94 X |
| 4,706,858 | 11/1987 | Whatley | 2/94 X |
| 4,739,913 | 4/1988 | Moore | 224/215 |
| 4,813,080 | 3/1989 | Toso | 2/94 |
| 4,864,654 | 9/1989 | Schriver et al. | 2/84 |
| 4,868,928 | 9/1989 | Norwell | 2/97 X |
| 4,959,876 | 10/1990 | Kalaan et al. | 2/97 X |
| 4,964,405 | 10/1990 | Arnoth | 128/205.17 |
| 4,979,659 | 12/1990 | Boyd | 224/205 |
| 4,998,654 | 3/1991 | Bruzek et al. | 224/205 X |
| 4,999,850 | 3/1991 | Grilliot et al. | 2/97 X |
| 5,014,355 | 5/1991 | Vollenweider | 128/202.19 X |

FOREIGN PATENT DOCUMENTS

| | | | |
|---|---|---|---|
| 766233 | 2/1954 | Fed. Rep. of Germany | 224/215 |
| 1031137 | 5/1958 | Fed. Rep. of Germany | 128/205.22 |
| 432249 | 9/1967 | Switzerland | 128/205.22 |

*Primary Examiner*—Henry J. Recla
*Assistant Examiner*—Glenn T. Barrett
*Attorney, Agent, or Firm*—Killworth, Gottman, Hagan & Schaeff

[57] ABSTRACT

An arrangement for supporting a self-contained breathing apparatus (SCBA) on a firefighter's turnout coat includes a vest-type garment composed of a back panel and shoulder and waist straps attached to respective upper and lower portions of the back panel. Releasable coupling devices are connected to the ends of the shoulder and waist straps for detachably connecting the respective ends together to tightly secure the vest-type garment on the wearer. The back panel of the garment can be secured to either the inside or the outside of the back of an outer protective shell of the coat. The shoulder and waist straps of the vest-type garment are located internally of an inner liner of the coat by extending from the back panel of the vest-type garment through slots in the inner liner. The SCBA supporting arrangement also includes an elongated flexible pouch mounted in the center of the exterior of the back of the outer shell of the coat for holding an air bottle of the SCBA. The pouch is mounted either directly on the back panel when attached to the outside of the outer shell of the coat or indirectly on the back panel when attached to the inside of the outer shell. The pouch includes bands or straps attached to the pouch and back panel to firmly secure the air bottle therein.

20 Claims, 4 Drawing Sheets

SUPPORT ARRANGEMENTS FOR FIREFIGHER'S SELF-CONTAINED BREATHING APPARATUS

BACKGROUND OF THE INVENTION

The present invention generally relates to protective fire fighting equipment and, more particularly, to an arrangement located on a firefighter's turnout coat for supporting a self-contained breathing apparatus (SCBA).

A firefighter's turnout coat typically includes an outer protective shell and an inner liner. The outer shell is fabricated, for instance, of an abrasion resistant material. The inner liner is fabricated of a combination of a moisture resistant material and an insulation material such that the inner liner is capable of impeding the transfer of both moisture and heat through the coat to the firefighter.

Heretofore, a self-contained breathing apparatus (SCBA) used by firefighters has been mounted by a support arrangement that includes shoulder straps worn over the exterior of the turnout coat. This support arrangement has several drawbacks. When the support arrangement is tightly secured over the exterior of the coat worn by the firefighter, the shoulder straps of the support arrangement compress the insulation material of the coat located under the straps. This results in a reduced insulation value of the compressed portions of the turnout coat and also in division of the insulation material of the coat into compartments. Air circulation within the coat between the compartments is reduced and restricted by the tight external support straps, as also is access to coat pockets. Further, when a "breathable" material, sold for example under the trademark Gore-Tex, is used for the moisture barrier, the outside straps interfere with the breathability of the material.

Consequently, a need exists for improvement of the support arrangement for a SCBA so as to avoid these drawbacks and enhance the protection provided to the firefighter by the turnout coat.

SUMMARY OF THE INVENTION

The present invention provides a SCBA support arrangement designed to satisfy the aforementioned needs. The support arrangement includes a vest-type garment composed of a back panel and shoulder and waist straps attached to respective upper and lower portions of the back panel. Releasable coupling devices are connected to the ends of the shoulder and waist straps for detachably connecting the respective ends together to tightly secure the vest-type garment on the wearer. The shoulder and waist straps of the vest-type garment are located internally of the inner liner of the coat. The shoulder straps are connected between the back panel and the waist strap.

The back panel can be secured to either the inside or the outside of the back of the outer shell of the turnout coat. The shoulder and waist straps extend from the back panel of the vest-type garment through slots in the inner liner of the coat. The slots are preferably surrounded by stub sleeves attached to the inner liner such that the straps extending through the slots also extend through the stub sleeves so as to prevent any reduction in the moisture resistance and insulation due to the slots in the inner liner. In such manner, the shoulder and waist straps are secured directly to the wearer preventing compression and compartmentalization of the bulk of the turnout coat including both the outer shell and the inner liner.

The support arrangement also includes an elongated flexible pouch mounted in the center of the exterior of the back of the outer shell of the turnout coat for holding an air bottle of the SCBA. The pouch is mounted either directly on the back panel of the vest-type garment when the back panel is attached to the outside of the outer shell of the coat or indirectly on the back panel of the vest-type garment when attached to the inside of the outer shell. The pouch includes bands or straps attached to the pouch and back panel to secure the air bottle therein. While a pouch is illustrated as the preferred form of support for the air bottle, any means of supporting the air bottle can be used in the present invention. For example a variety of brackets for snapping, hooking or otherwise rapidly engaging and disengaging an air bottle as well as other air bottle supports are envisioned for use in the present invention.

It is thus an object of the present invention to provide an improved support arrangement for a SCBA which is substantially internal to a turnout coat to reliably support the SCBA without substantially reducing the protection afforded a firefighter by the turnout coat or the wearability of the coat.

Other objects and advantages of the invention will be apparent from the following description, the accompanying drawings and the appended claims.

DETAILED DESCRIPTION OF THE INVENTION

Figure 1:
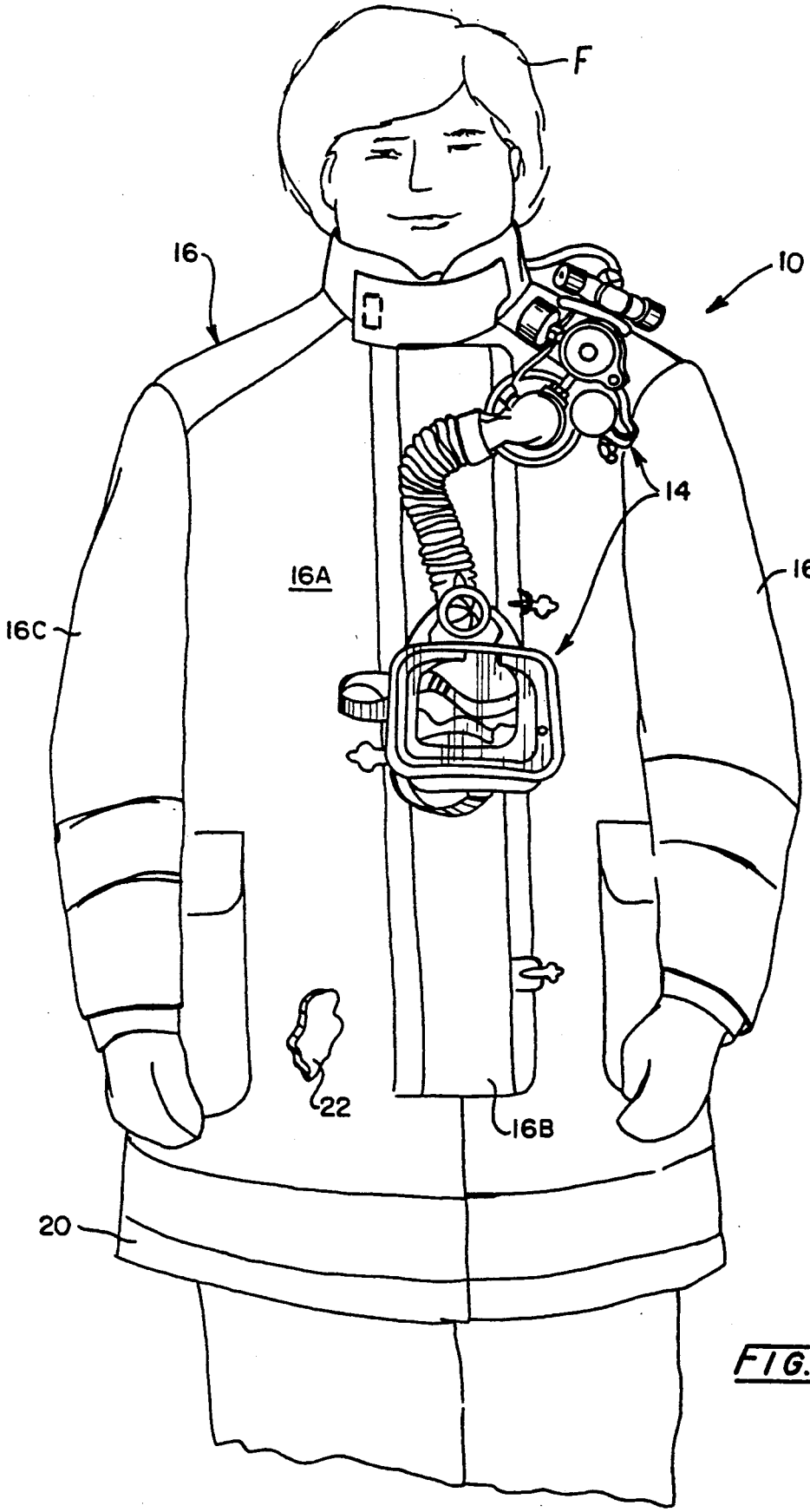
FIG. 1 is a front elevational view of a firefighter wearing a turnout coat incorporating a SCBA supported by a support arrangement in accordance with the present invention.
Figure 2:
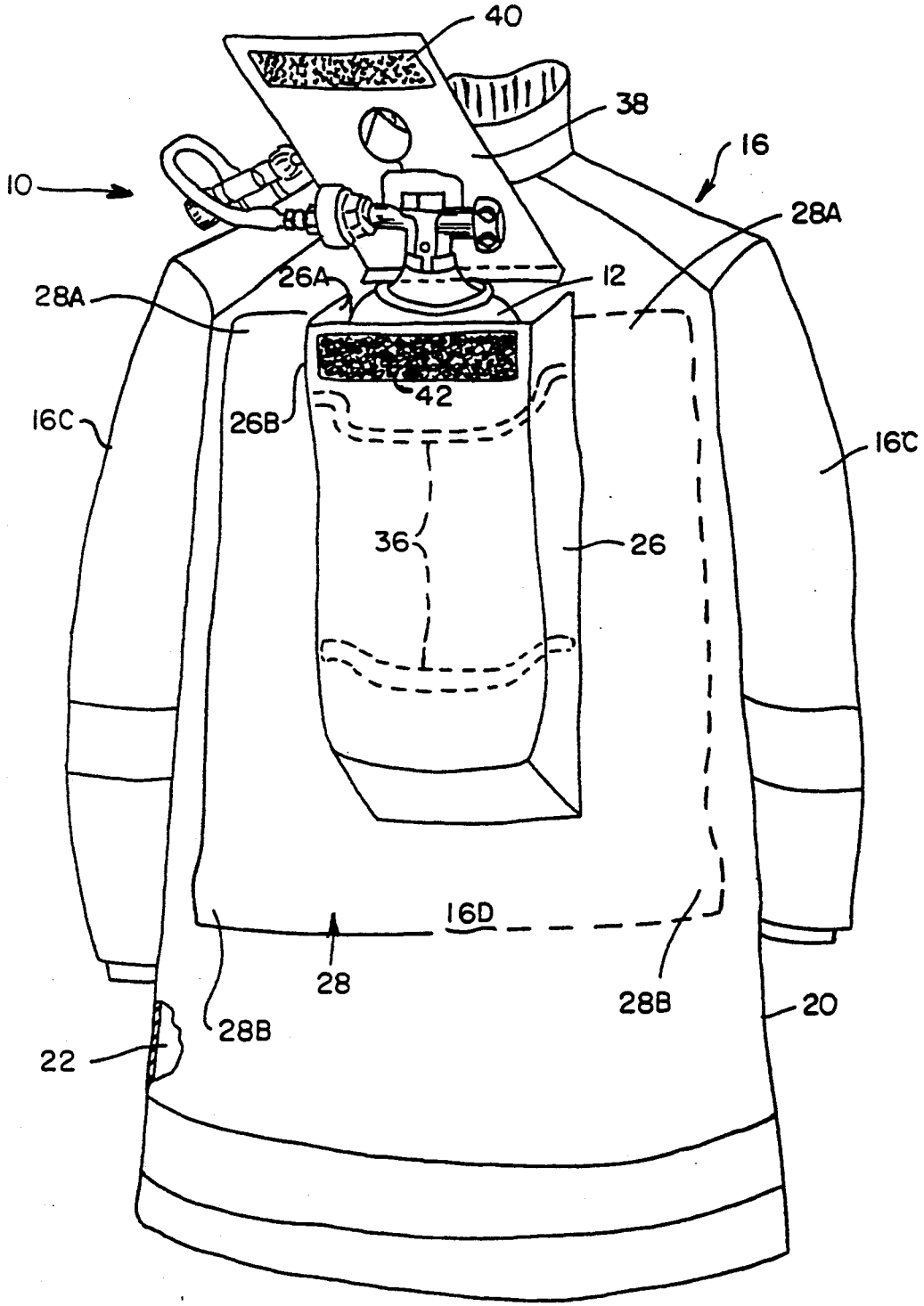
FIG. 2 is a rear elevational view of the turnout coat of FIG. 1, illustrating the attachment of a back panel of a vest-type garment of the support arrangement to the coat and to a pouch containing an air bottle of the SCBA.
Figure 3:
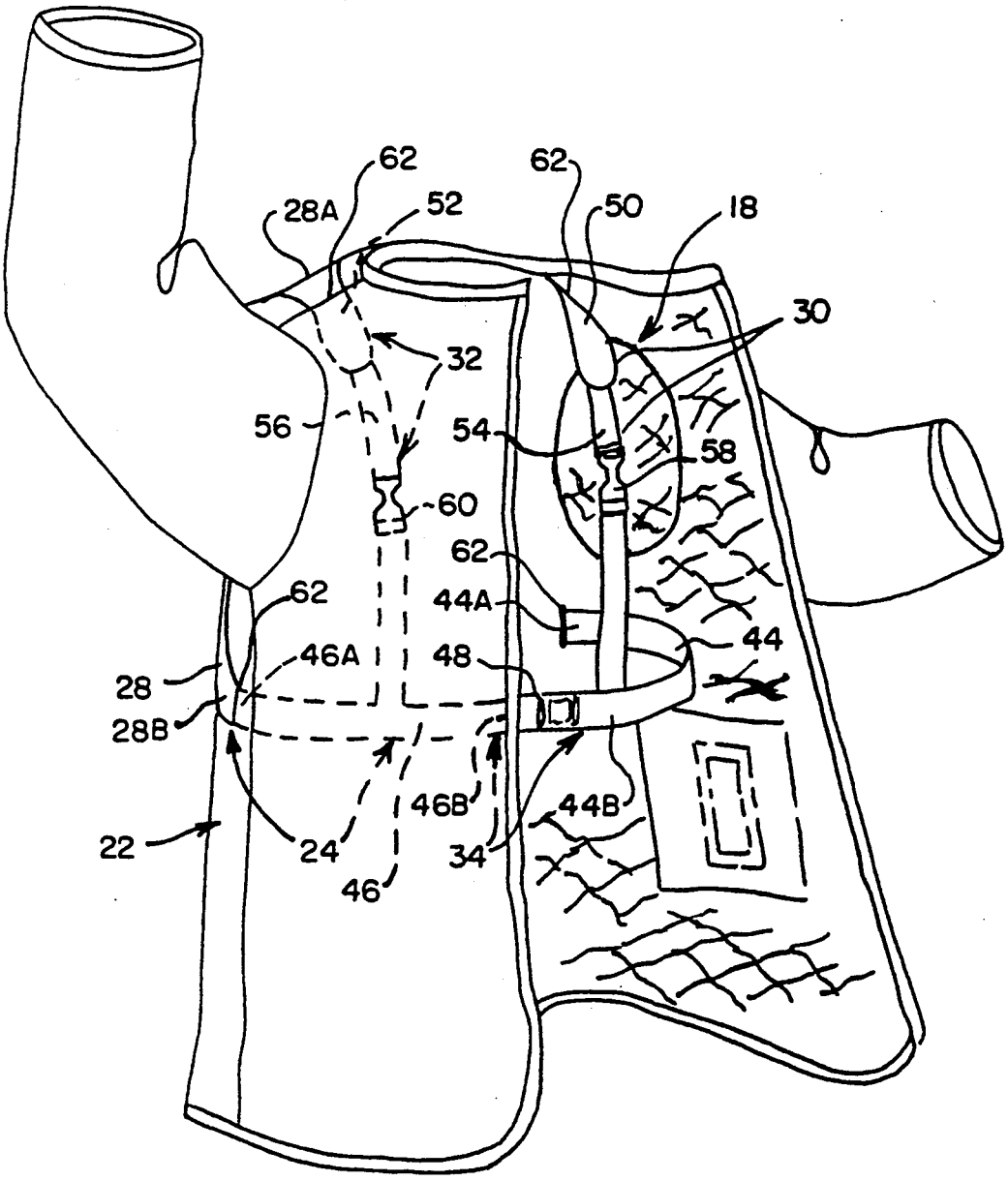
FIG. 3 is a front elevational view of an inner liner of the coat of FIG. 1, illustrating the inner liner in partially opened condition to expose the shoulder and waist straps and the coupling buckles of the vest-type garment of the support arrangement of the present invention.

Referring now to the drawings, and particularly to FIGS. 1–3, there is illustrated the typical components of a self-contained breathing apparatus (SCBA) 10, such as an air tank 12 and an air flow regulator assembly 14 connected to the air tank 12. The air tank 12 of the SCBA 10 is supported on a coat 16, such as a turnout coat of a firefighter F, by a support arrangement 18 in accordance with the principles of the present invention.

As conventionally provided, the turnout coat 16 has a body portion 16A for covering the torso of the firefighter F and which can be opened and closed at front vertical edges hidden behind a flap portion 16B. The coat 16 also has a pair of sleeve portions 16C attached to the opposite upper sides of the body portion 16A for covering the arms of the firefighter F. The body and sleeve portions 16A, 16C of the coat 16 together are composed of an outer protective shell 20 and an inner liner 22. The outer shell 20 is fabricated, for instance, of a suitable abrasion resistant material, such as a lightweight, fire-resistant material sold for example under the trademark Nomex. The inner liner 22 is fabricated of a suitable insulation barrier material, sold for example under the trademark Nomex Quilt, and a moisture barrier material, sold for example under the trademark Gore-Tex such that the inner liner is capable of impeding the transfer of both heat and moisture through the coat 16 to the firefighter F.

Figure 4:
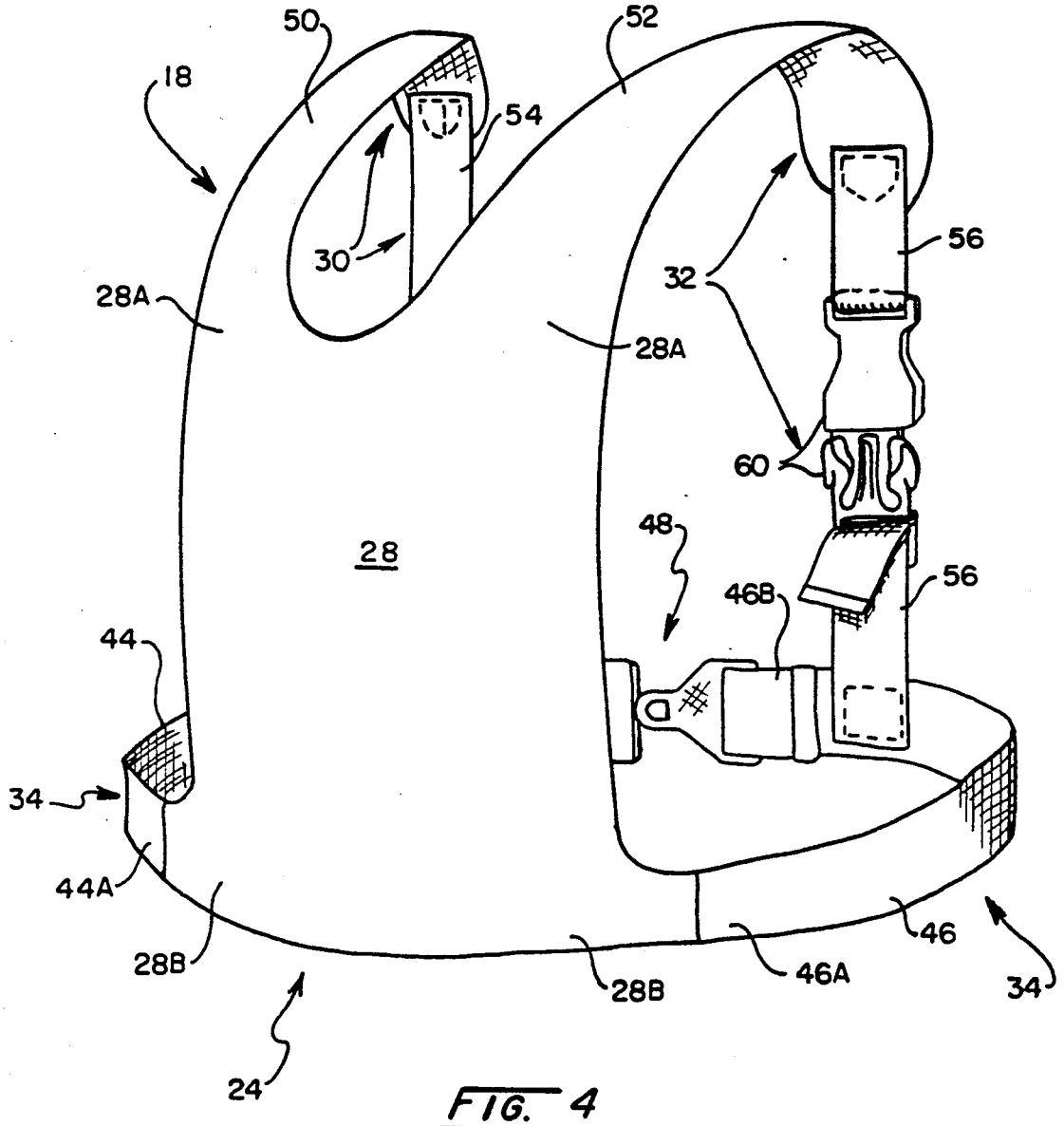
FIG. 4 is an enlarged rear perspective view of the support arrangement of the present invention removed from the coat.

Referring to FIGS. 2–4, in its basic components, the support arrangement 18 includes a vest-type garment 24, and holding means on the exterior of the back of the outer shell 20 of the coat 16 for holding the air tank 12 of the SCBA 10. In the illustrated embodiment, the holding means takes the form of an elongated flexible pouch 26; however, it is noted that any means of holding or supporting the air bottle can be used in the present invention. For example a variety of brackets for snapping, hooking or otherwise rapidly engaging and disengaging an air bottle as well as other air bottle supports are envisioned for use as the holding means in the present invention. The garment 24 can be fabricated from any suitable material, such as materials sold under the trademarks Nomex or Kevlar, while the pouch 26 is preferably fabricated from the same material as the outer shell 20.

The vest-type garment 24 is composed of a back panel 28 which, in the illustrated embodiment, is substantially coextensive with the upper portion of the back 16D of the coat 16; however, the panel 28 can be reduced in size toward the size of the pouch 26 or other holding means as desired. Left and right shoulder straps 30, 32 and waist strap 34 are attached to respective upper and lower opposite corner portions 28A, 28B of the back panel 28. The back panel 28 of the vest-type garment 24 can be secured to either the outside of the outer shell 20 as shown by the solid line left-half of the back panel 28 in FIG. 2 or the inside of the outer shell 20 as shown by the dotted line right-half of the back panel 28 in FIG. 2 at the back 16D of the coat 16.

The pouch 26 is attached to the back panel 28 of the garment 24. The pouch 26 can have an elongated rectangular shape as shown in FIG. 2, a cylindrical shape or other air tank receiving shape or can be replaced by other air tank holding means as previously noted. A plurality of elastic straps 36 are provided in the pouch 26 and attached to the back panel 28 for securing the air tank 12 in the pouch 26. The straps may be elastic or preferably adjustable strapping to more securely engage the air tank 12. The pouch 26 is illustrated as having a hinged closure flap 38 for closing an upper open end 26A of the pouch 26. A pair of patches 40, 42 of complementary hook and pile material are affixed respectively to the flap 38 and upper edge 26B of the pouch 26 for releasably attaching the flap 38 to the upper edge 26B so as to overlie the open end 26A of the pouch 26. Alternately, an elastic band can be provided to draw the upper open end of the pouch 26 around the air tank 12.

In the preferred form shown in FIG. 2, the back panel 28 of the garment 24 is attached on the outside of the outer shell 20 at the back 16D of the coat 16 and so the pouch 26 is attached directly to the back panel 28. In an alternative form shown in FIG. 3, the back panel 28 of the garment 24 is disposed adjacent to the outside of the inner liner 22 and attached to the inside of the outer shell 20. In the latter case, the pouch 26 is attached indirectly to the back panel 28 through the outer shell 20 of the coat 16. The attachments between the back panel 28 of the garment 24 and the pouch 26 and outer shell of the coat 16 can be accomplished in any suitable manner, such as by stitching, by use of a suitable adhesive or otherwise.

The left and right shoulder straps 30, 32 and the waist strap 34 of the garment 24 are located internally of the inner liner 22 of the coat 16. The Waist strap 34 is composed of a pair of left and right strap sections 44, 46 having end portions 44A, 46A attached respectively to the lower opposite corners 28B of the back panel 28. The waist strap 34 also has a releasable coupling device 48 in the form of an adjustable buckle 48 attached to respective ends 44B, 46B of the waist strap 34.

The left and right shoulder straps 30, 32 are composed of left and right extension portions 50, 52 which are integrally connected to the back panel 28 at the upper opposite corners 28A thereof. The left and right shoulder straps 38, 32 are also composed of pairs of left and right strap portions 54, 56 attached to and extending between the left and right extension portions 50, 52 and the ends 44B, 46B of the waist strap sections 44, 46. The pairs of strap sections 54, 56 having respective releasable coupling devices 58, 60 in the form of left and right adjustable buckles 58, 60 interposed therein. The waist and shoulder strap buckles 48 and 58, 60 and the waist and shoulder straps 34 and 30, 32 are adjustable to the size of a particular wearer in order to tightly secure the vest-type garment 24 on the wearer. It will be noted that the waist and shoulder straps 34 and 30, 32 directly engage the shoulders and waist of the wearer.

Figure 5:
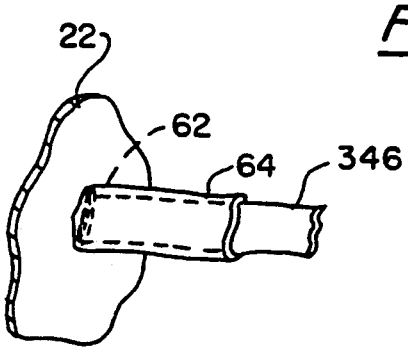
FIG. 5 is an enlarged fragmentary side elevational view of one of the slots in the inner liner of the coat, with the slot being surrounded by a sleeve on the coat with one of the straps extending therefrom.

Referring to FIGS. 3 and 5, the support arrangement 18 also includes a plurality of slots 62 defined through the inner liner 22 of the coat 16 adjacent the upper and lower opposite corner portions 28A, 28B of the back panel 28. The left and right shoulder straps 30, 32 and the waist strap 34 of the garment 24 at their respective end portions extend from the back panel 28 of the garment 24 through the slots 62 in the inner liner 22 of the coat 16.

The support arrangement 18 further includes a plurality of stub sleeves 64 attached to the inner liner 22 of the coat 16 and surrounding the slots 62 therethrough. The end portions of the shoulder straps 30, 32 and waist strap 34 of the garment 24 extend through the stub sleeves 64. The stub sleeves 64 can extend from either side of the inner liner 22 or extend from both sides of the inner liner 22 and serve to extend both the moisture barrier and insulation barrier along the stub sleeves. The extension of the moisture/insulation barriers of the inner liner 22 by the stub sleeves 64 in combination with the straps inserted through the stub sleeves 64 substantially maintains the integrity of both the moisture barrier and the insulation barrier in spite of the slots 62.

The support arrangement 18 of the present invention by providing shoulder and waist straps 30, 32, 34 interiorly of the inner liner 22 in direct contact with the clothing covering the wearer's torso alleviates the problems of compression of the insulation, interference with breathability of the moisture barrier material, and bunching up and compartmentalization of the coat 16 as experienced heretofore. As a result air flow, moisture resistance and proper insulation are maintained.

Having thus described the support arrangement of the present invention in detail and by reference to preferred embodiments thereof, it will be apparent that certain modifications and variations are possible without departing from the scope of the invention defined in the appended claims.

What is claimed is:

1. In a coat including an outer protective shell and a removable inner liner, an arrangement for supporting a self-contained breathing apparatus, said arrangement comprising:

(a) a vest-type garment being composed of a back panel, shoulder straps and a waist strap wherein said shoulder straps and said waist strap each include first ends attached to said back panel and second ends remote from said back panel, and means for detachably connecting said second ends of said respective shoulder and waist straps together to tightly secure said garment on a wearer, said back panel being secured to said coat such that said shoulder and waist straps of said garment extend through said removable inner liner of said coat; and (b) means on an exterior back portion of said outer protective shell of said coat for holding an air tank of the breathing apparatus, said air tank holding means being attached to said back panel of said garment.

2. The arrangement of claim 1 wherein said connecting means are releasable coupling devices connected to said second ends of said shoulder and waist straps for detachably connecting said respective ends of said straps together.

3. The arrangement of claim 1 wherein said shoulder straps are connected to said waist strap.

4. The arrangement of claim 1 wherein said holding means includes an elongated flexible pouch attached to said back panel of said garment.

5. The arrangement of claim 1 wherein said outer protective shell has an inside and an outside and said back panel of said garment is attached on the outside of said outer protective shell of said coat.

6. The arrangement of claim 5 wherein said holding means includes an elongated flexible pouch attached directly to said back panel of said garment.

7. In a coat including an outer protective shell and an inner liner, an arrangement for supporting a self-contained breathing apparatus, said arrangement comprising:

(a) a vest-type garment being composed of a back panel, shoulder straps and a waist strap wherein said shoulder straps and said waist strap each include first ends attached to said back panel and second ends remote from said back panel, and means for detachably connecting said second ends of said respective shoulder and waist straps together to tightly secure said garment on a wearer, said back panel being secured to said coat such that said shoulder and waist straps of said garment extend through said inner liner of said coat; and (b) means on an exterior back portion of said outer protective shell of said coat for holding an air tank of the breathing apparatus, said air tank holding means being attached to said back panel of said garment and includes an elongated flexible pouch attached to said back panel of said garment and a plurality of straps attached to said pouch and said back panel for securing the air bottle in said pouch.

8. In a coat including an outer protective shell and an inner liner, an arrangement for supporting a self-contained breathing apparatus, said arrangement comprising:

(a) a vest-type garment being composed of a back panel, shoulder straps and a waist strap wherein said shoulder straps and said waist strap each include first ends attached to said back panel and second ends remote from said back panel, and means for detachably connecting said second ends of said respective shoulder and waist straps together to tightly secure said garment on a wearer, said outer protective shell having an inside and an outside with said back panel of said garment being attached to said inside of said outer protective shell of said coat and such that said shoulder and waist straps of said garment extend through said inner liner of said coat; and (b) means on an exterior back portion of said outer protective shell of said coat for holding an air tank of the breathing apparatus, said air tank holding means being attached to said back panel of said garment.

9. The arrangement of claim 8 wherein said holding means includes an elongated flexible pouch attached indirectly to said back panel of said garment through said outer protective shell of said coat.

10. In a coat including an outer protective shell and an inner liner, an arrangement for supporting a self-contained breathing apparatus, said arrangement comprising:

(a) a vest-type garment being composed of a back panel, shoulder straps and a waist strap wherein said shoulder straps and said waist strap each include first ends attached to said back panel and second ends remote from said back panel, and means for detachably connecting said second ends of said respective shoulder and waist straps together to tightly secure said garment on a wearer, said back panel being secured to said coat, said inner liner of said coat having a plurality of slots defined therethrough, wherein said second ends of said shoulder and waist straps of said garment extend from said back panel of said garment through said slots in said inner liner of said coat; and (b) means on an exterior back portion of said outer protective shell of said coat for holding an air tank of the breathing apparatus, said air tank holding means being attached to said back panel of said garment.

11. The arrangement of claim 10 wherein said coat has a plurality of stub sleeves attached to said removable inner liner and surrounding said slots therethrough, said second ends of said shoulder and waist straps of said garment extending through said stub sleeves.

12. In a coat including an outer protective shell and an inner liner providing both a moisture barrier and an insulation barrier, an arrangement for supporting a self-contained breathing apparatus, said arrangement comprising:

(a) a vest-type garment being composed of a back panel, shoulder straps and a waist strap wherein said shoulder straps and said waist strap each include first ends attached to respective upper and lower portions of said back panel and second ends remote from said back panel, and means for detachably connecting said second ends of said respective shoulder and waist straps together to tightly secure said garment on a wearer, said back panel being secured to said coat such that said shoulder and waist straps of said garment extend through said inner liner of said coat, said inner liner of said coat having a plurality of slots defined therethrough, said second ends of said shoulder and waist straps extending through said slots in said inner liner of said coat; and (b) an elongated flexible pouch located on an exterior back portion of said outer protective shell of said coat and attached to said back panel of said garment for holding an air tank of the breathing apparatus.

13. The arrangement of claim 12 wherein said connecting means are releasable coupling devices connected to said second ends of said shoulder and waist straps for detachably connecting said respective ends of said straps together.

14. The arrangement of claim 12 wherein said shoulder straps are connected to said waist strap.

15. The arrangement of claim 12 further comprising a plurality of straps attached to said pouch and said back panel for securing the air bottle in said pouch.

16. The arrangement of claim 12 wherein said outer protective shell has an inside and an outside and said back panel of said garment is attached on the outside of said outer protective shell of said coat.

17. The arrangement of claim 16 wherein said pouch is attached directly to said back panel of said garment.

18. The arrangement of claim 12 wherein said outer protective shell has an inside and an outside and said back panel of said garment is attached to the inside of said outer protective shell of said coat.

19. The arrangement of claim 18 wherein said pouch is attached indirectly to said back panel of said garment through said outer shell of said coat.

20. The arrangement of claim 12 wherein said inner liner of said coat has a plurality of stub sleeves attached to said inner liner and surrounding said slots therethrough, said end portions of said shoulder and waist straps of said garment extending through said stub sleeves.

* * * * *